US008544705B2

(12) United States Patent
Su

(10) Patent No.: US 8,544,705 B2
(45) Date of Patent: Oct. 1, 2013

(54) MULTI-FUNCTIONAL BELT BUCKLE

(76) Inventor: Yung-Fa Su, Kaohsiung Hsien (TW)

( * ) Notice: Subject to any disclaimer, the term of this patent is extended or adjusted under 35 U.S.C. 154(b) by 26 days.

(21) Appl. No.: 13/070,453

(22) Filed: Mar. 23, 2011

(65) Prior Publication Data

US 2011/0167597 A1 Jul. 14, 2011

Related U.S. Application Data

(63) Continuation-in-part of application No. 11/755,745, filed on May 31, 2007, now abandoned.

(51) Int. Cl.
*A45F 5/00* (2006.01)

(52) U.S. Cl.
USPC ..... 224/163; 224/183

(58) Field of Classification Search
USPC ..... 224/163, 183, 918
See application file for complete search history.

(56) References Cited

U.S. PATENT DOCUMENTS

| | | | | |
|---|---|---|---|---|
| 4,052,773 | A * | 10/1977 | Nesbitt | 24/163 K |
| 5,282,616 | A * | 2/1994 | Stacavich-Notaro | 473/406 |
| D350,179 | S * | 8/1994 | Johnson | D21/794 |
| 5,795,248 | A * | 8/1998 | Giglio | 473/406 |
| 6,142,348 | A * | 11/2000 | Park | 224/163 |
| 6,170,088 | B1 * | 1/2001 | Tate | 2/209.13 |
| 6,253,974 | B1 * | 7/2001 | Park | 224/163 |
| 6,422,955 | B1 * | 7/2002 | Lopez | 473/406 |
| 6,569,039 | B1 * | 5/2003 | Cope | 473/406 |
| 6,820,282 | B1 * | 11/2004 | England et al. | 2/161.1 |
| 6,966,851 | B1 * | 11/2005 | England et al. | 473/406 |
| D540,902 | S * | 4/2007 | Regalado | D21/794 |
| 7,226,370 | B1 * | 6/2007 | Cope | 473/406 |
| 2001/0016526 | A1 * | 8/2001 | Tate | 473/406 |
| 2002/0034992 | A1 * | 3/2002 | Tate | 473/406 |
| 2006/0234813 | A1 * | 10/2006 | Kuroda | 473/406 |

FOREIGN PATENT DOCUMENTS

JP 2005102778 A * 4/2005

* cited by examiner

*Primary Examiner* — Nathan J Newhouse
*Assistant Examiner* — Lester L Vanterpool
(74) *Attorney, Agent, or Firm* — Alan Kamrath; Kamrath IP Lawfirm, P.A.

(57) ABSTRACT

A belt buckle which has an indentation on the front surface accommodating a removable cap element held by magnetic attraction. The indentation has a stepwise bottom surface for easy removal of the cap element. In an alternative embodiment, the indentation accommodates a removable carrier member capable of integrating various functions such as electronic clock or remote control. The carrier member in turn has an indentation for removably holding a cap element by magnetic attraction. The carrier member's indentation has a stepwise bottom surface for easy removal of the cap element.

2 Claims, 16 Drawing Sheets

MULTI-FUNCTIONAL BELT BUCKLE

CROSS-REFERENCE

This is a continuation in part of patent application Ser. No. 11/755,745, filed May 31, 2007 now abandoned.

(a) TECHNICAL FIELD OF THE INVENTION

The present invention generally relates to belt buckles, and more particularly to a belt buckle having a removable cap element.

(b) DESCRIPTION OF THE PRIOR ART

As shown in FIG. 1, a conventional belt 1 has a belt buckle 12 fixedly attached to an end of a belt member 11. The other end of the belt member 11 is then locked to the belt buckle 12 for fastening the belt 1 around the waist. The basic structure of the belt just described has not been changed for a very long time. Variations are usually centered around the material used for the belt member 11, how the belt buckle 12 locks the tip of the belt member 11, or the ornamental design of the belt buckle 12.

Park (U.S. Pat. No. 6,142,348) discloses a buckle which comprises: a decoration part having a belt clamp used for clamping the buckle to a belt; a hooking post formed on a position opposite to the clamp and used for selectively fastening two ends of the belt together; a first through-opening formed on the decoration part; a marker seat formed by a rib horizontally extending across the first through-opening while leaving upper and lower through-openings inside the first through-opening of the seat relative to the rib, the rib also carrying a first magnet and acting as a point of application during a levering motion for detaching the marker from the seat; and a golf ball marker provided with a second magnet having a magnetic polarity opposite to that of the first magnet, the marker being magnetically and detachably seatable on the marker seat of the decoration part. However, it is very difficult to remove the marker from the buckle.

Therefore, it is an object of the present invention to provide a multi-function belt buckle which can obviate and mitigate the above-mentioned drawbacks.

SUMMARY OF THE INVENTION

A major objective of the present invention is to provide a novel belt buckle which has an indentation on the front surface accommodating a removable cap element held by magnetic attraction. The indentation has a stepwise bottom surface for easy removal of the cap element.

Another major objective of the present invention is to provide a novel belt buckle which has an indentation on the front surface accommodating a removable carrier member capable of integrating various function such as electronic clock and remote control. The carrier member in turn has an indentation for removably holding a cap element by magnetic attraction. The carrier member's indentation has a stepwise bottom surface for easy removal of the cap element.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
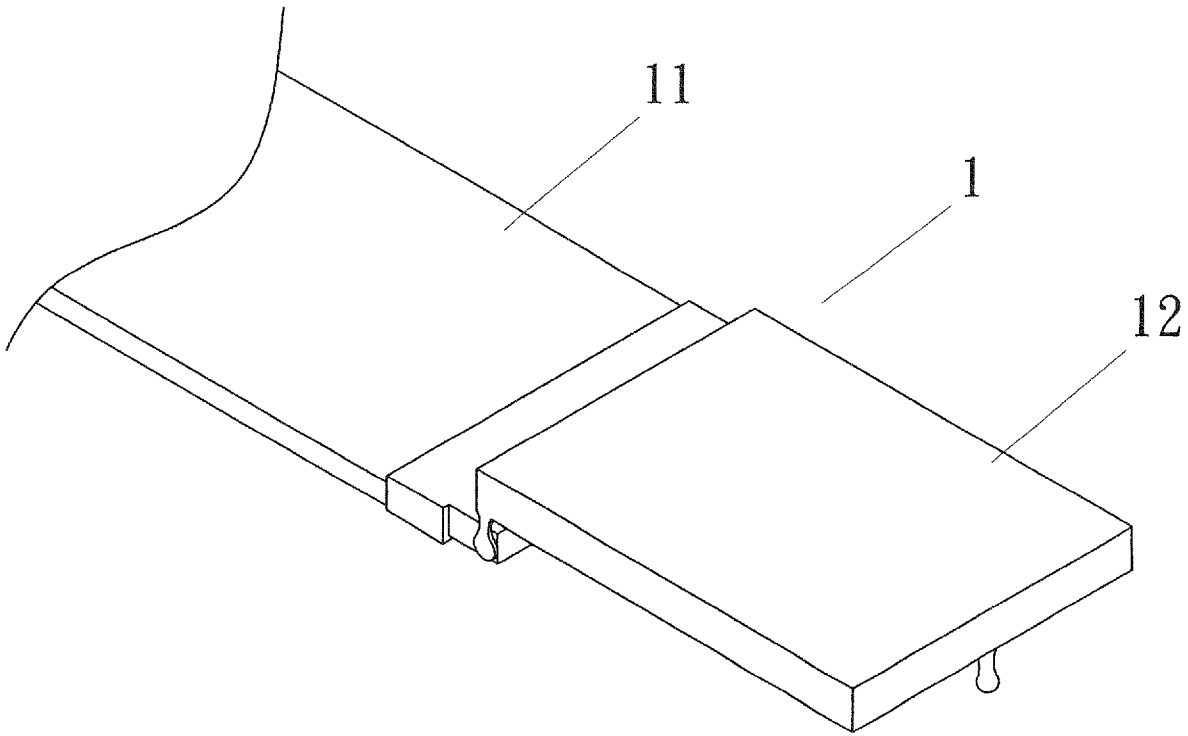
PRIOR ART FIG. 1
FIG. 1 is a perspective diagram showing a conventional belt buckle.
Figure 2:
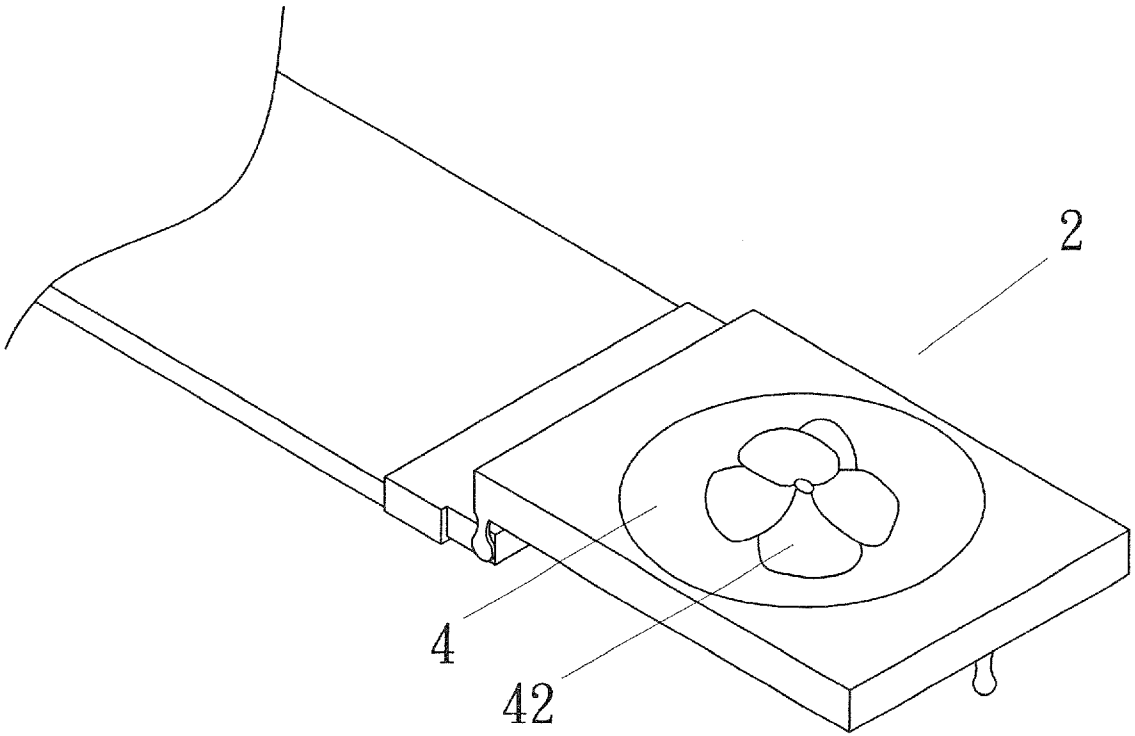
FIG. 2 is a perspective diagram showing a belt buckle according to a first embodiment of the present invention.
Figure 3:
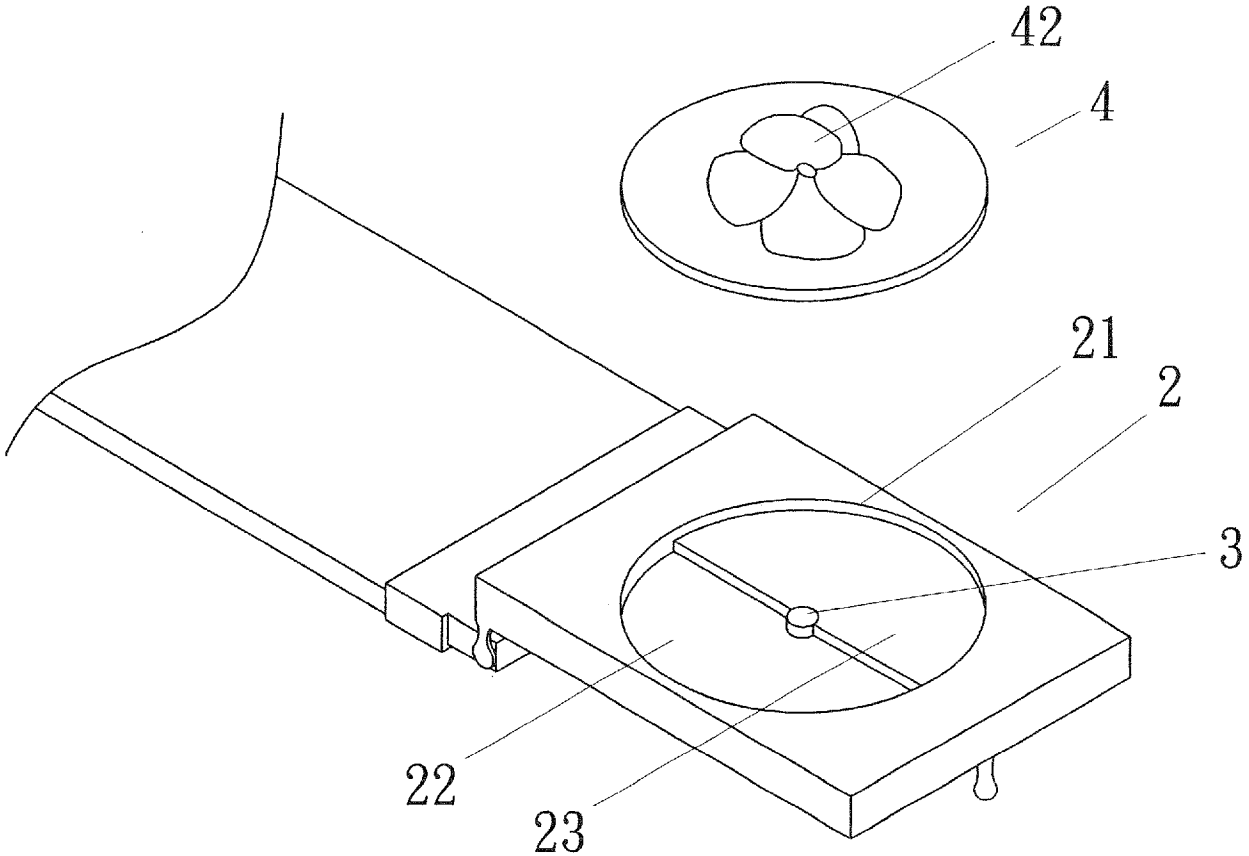
FIG. 3 is a perspective exploded diagram showing the various components of the belt buckle of FIG. 2.
Figure 4:
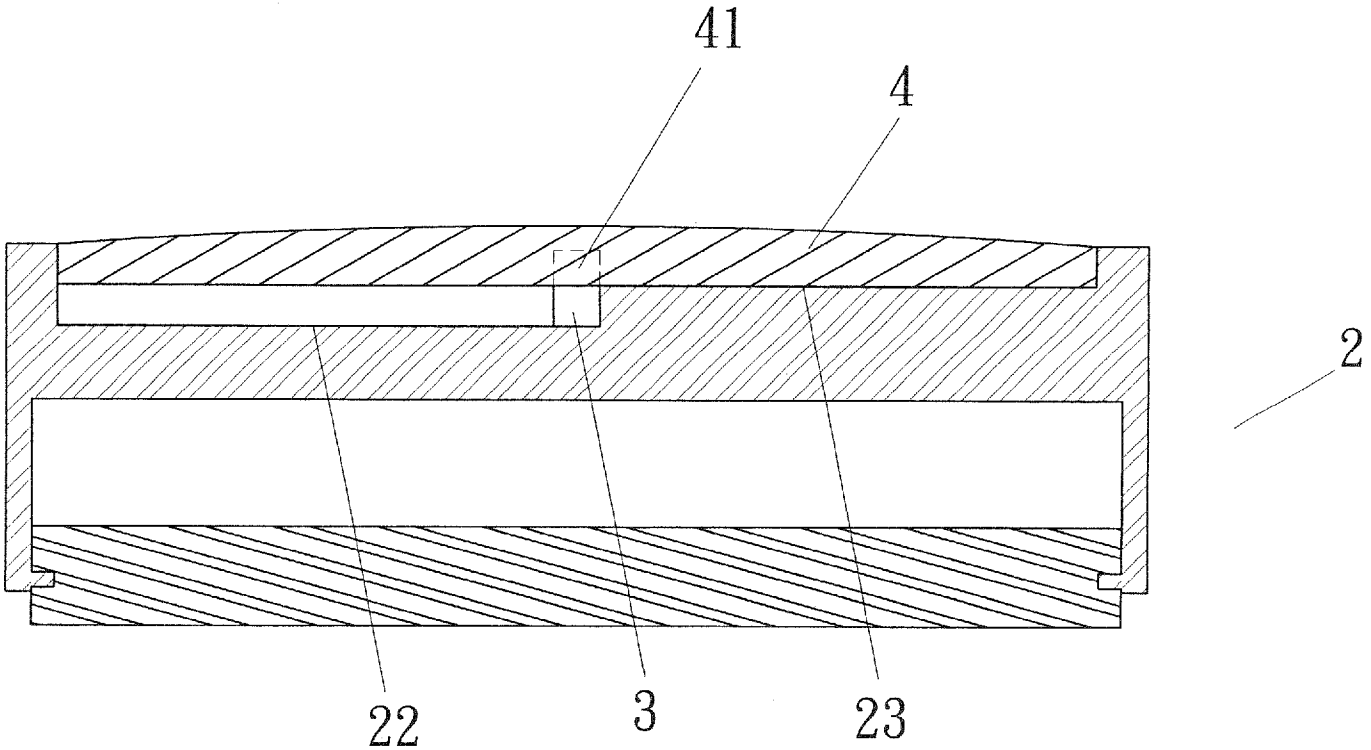
FIG. 4 is a sectional diagram showing the belt buckle of FIG. 2.

As shown in FIGS. 2, 3, and 4, a belt buckle 2 according to an embodiment of the present invention has an indentation 21 on the front surface of the body of the belt buckle 2. The bottom surface of the indentation 21 is divided into two parts of substantially equal sizes, a first bottom 22 having a greater depth and a second bottom 23 having a smaller depth. A magnet 3 is fixedly positioned in the center of the indentation 21 at where the first and second bottoms 22 and 23 interface with each other.

The indentation 21 allows the accommodation of a cap element 4. Another magnet 41 is fixedly embedded on the bottom surface of the cap element 4. The magnet 41 has a polarity opposite to that of the magnet 3 and is positioned such that, when the cap element 4 is placed inside the indentation 21, the magnets 3 and 41 are next to each other. The magnetic attraction between the magnets 3 and 41 therefore removably holds the cap element 4 inside the indentation 21. The front surface of the cap element 4 can have an ornamental pattern 42 such as a company, club, or team logo or even a picture for enhanced appearance.

Figure 5:
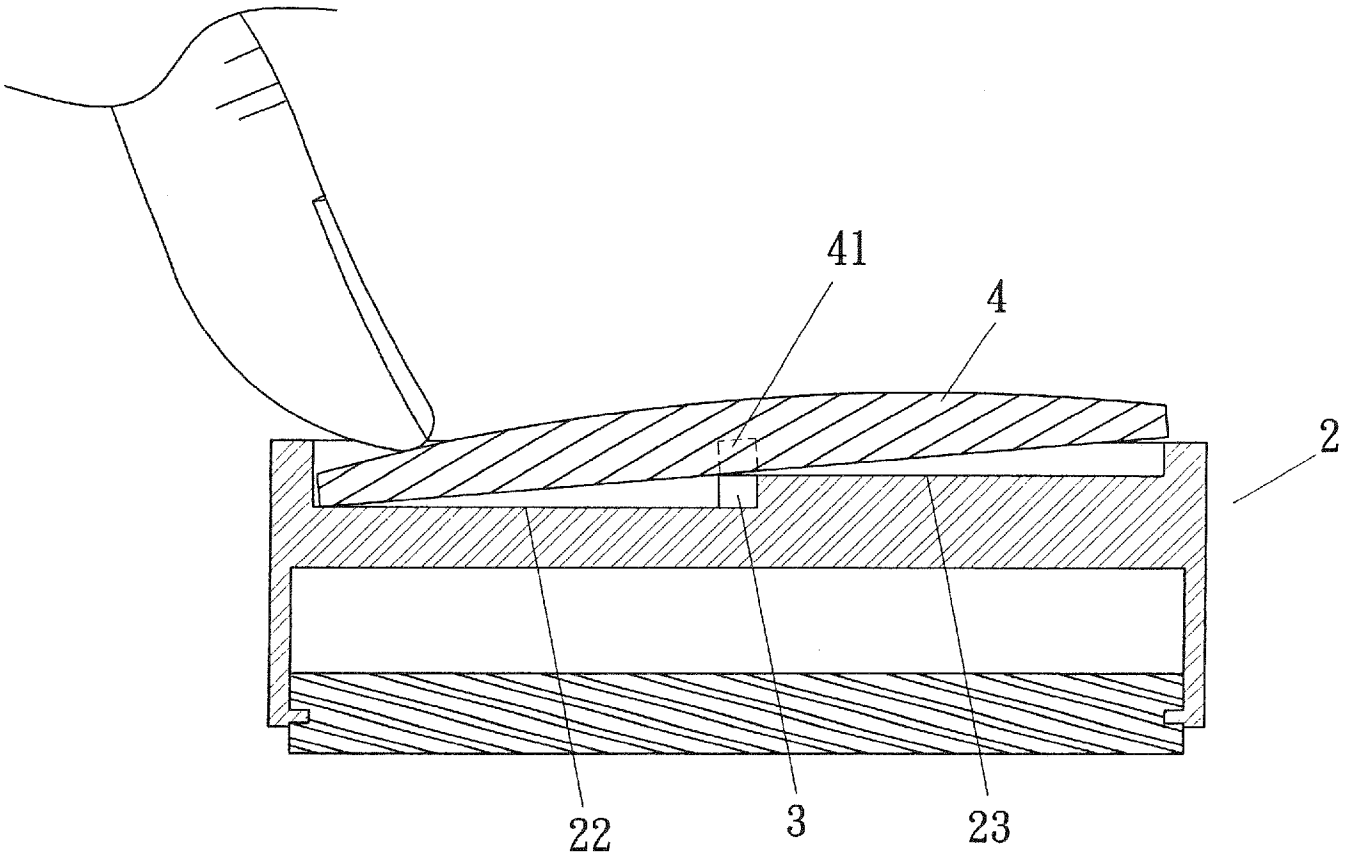
FIG. 5 is a sectional diagram showing how the cap element of the belt buckle of FIG. 2 is removed.

As shown in FIGS. 4 and 5, when the cap element 4 is placed inside the indentation 21, a gap is reserved between the bottom surface of the cap element 4 and the first bottom 22. As such, by pressing the part of the cap element 4 above the gap, the other part of the cap element 4 will be raised out of the indentation 21. The cap element 4 therefore can be easily removed from the indentation 21. In the present embodiment, the cap element 4 is very much like a coin and therefore can be used in various occasions as a substitute. For example, on the golf course, it can be used by a golfer to mark the position of the golf ball. For another example, in the supermarket, it can be used as a substitute for a coin to retrieve a chained shopping cart.

Figure 6:
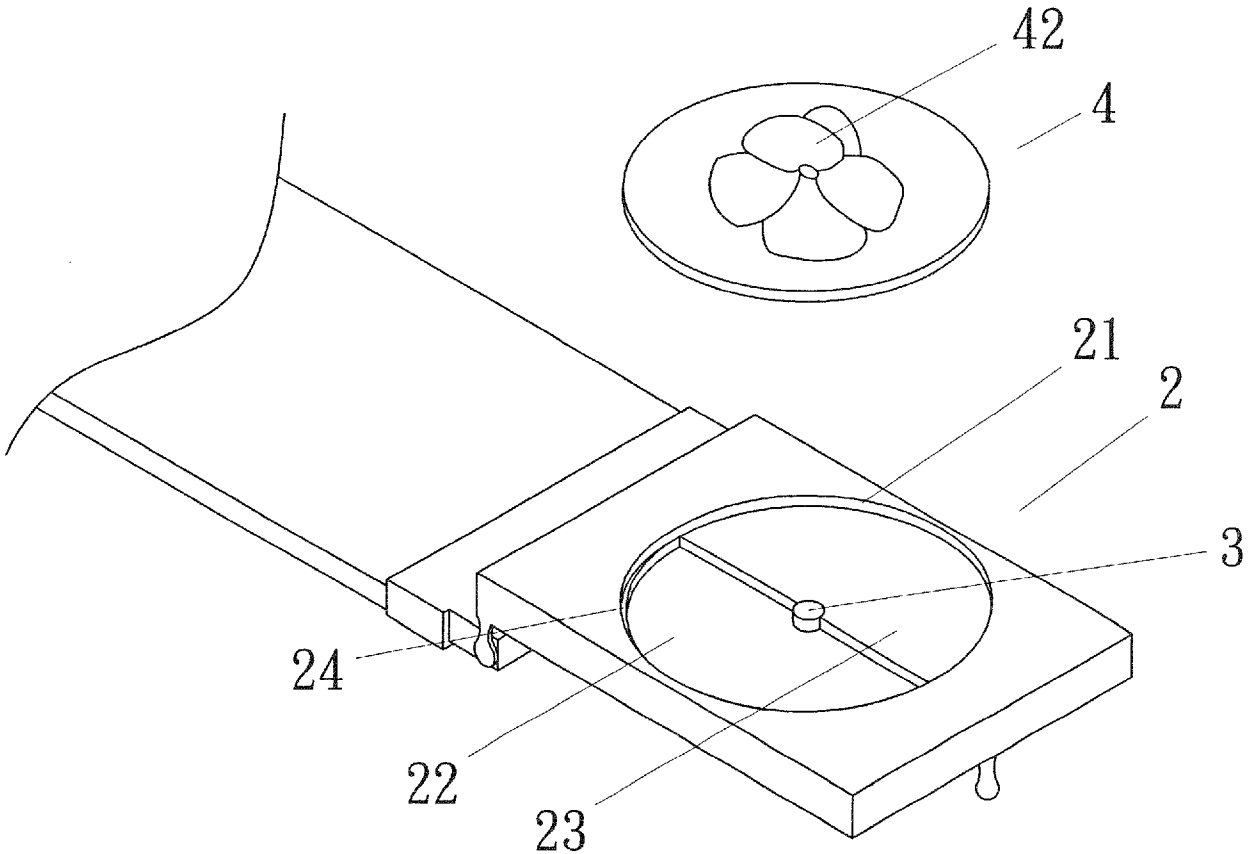
FIG. 6 is a perspective exploded diagram showing the various components of a belt buckle according to a second embodiment of the present invention.
Figure 6A:
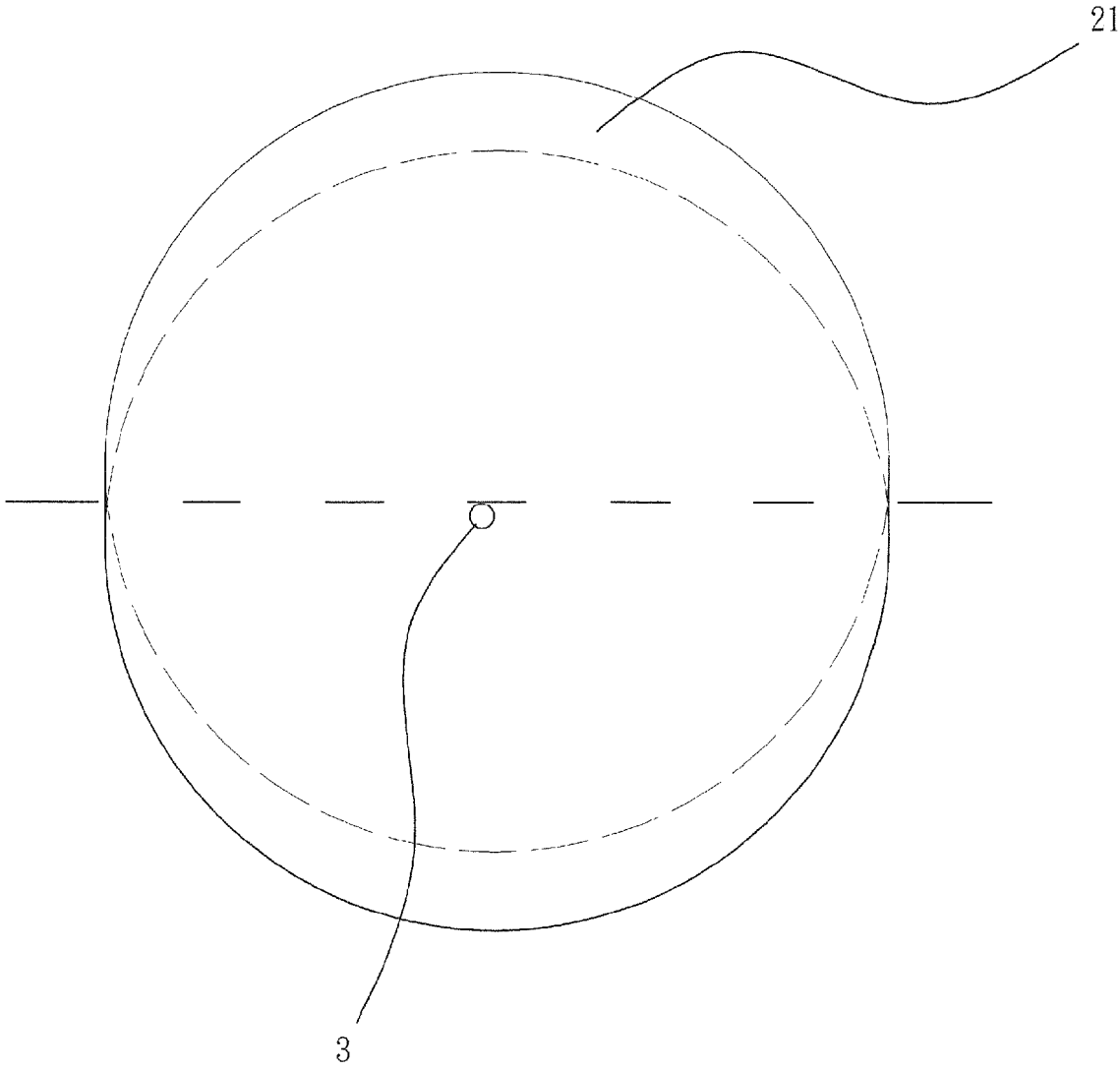
FIG. 6A illustrates the structure of the indentation.
Figure 7:
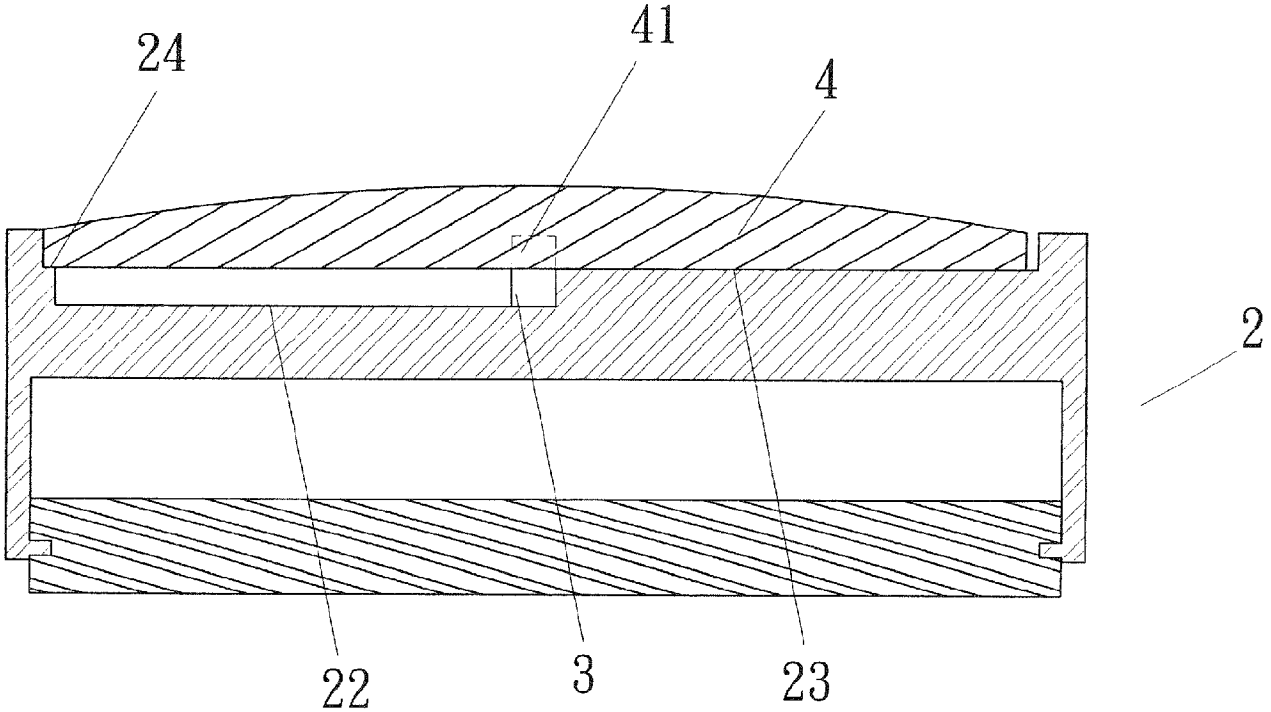
FIG. 7 is a sectional diagram showing the belt buckle of FIG. 6.
Figure 8:
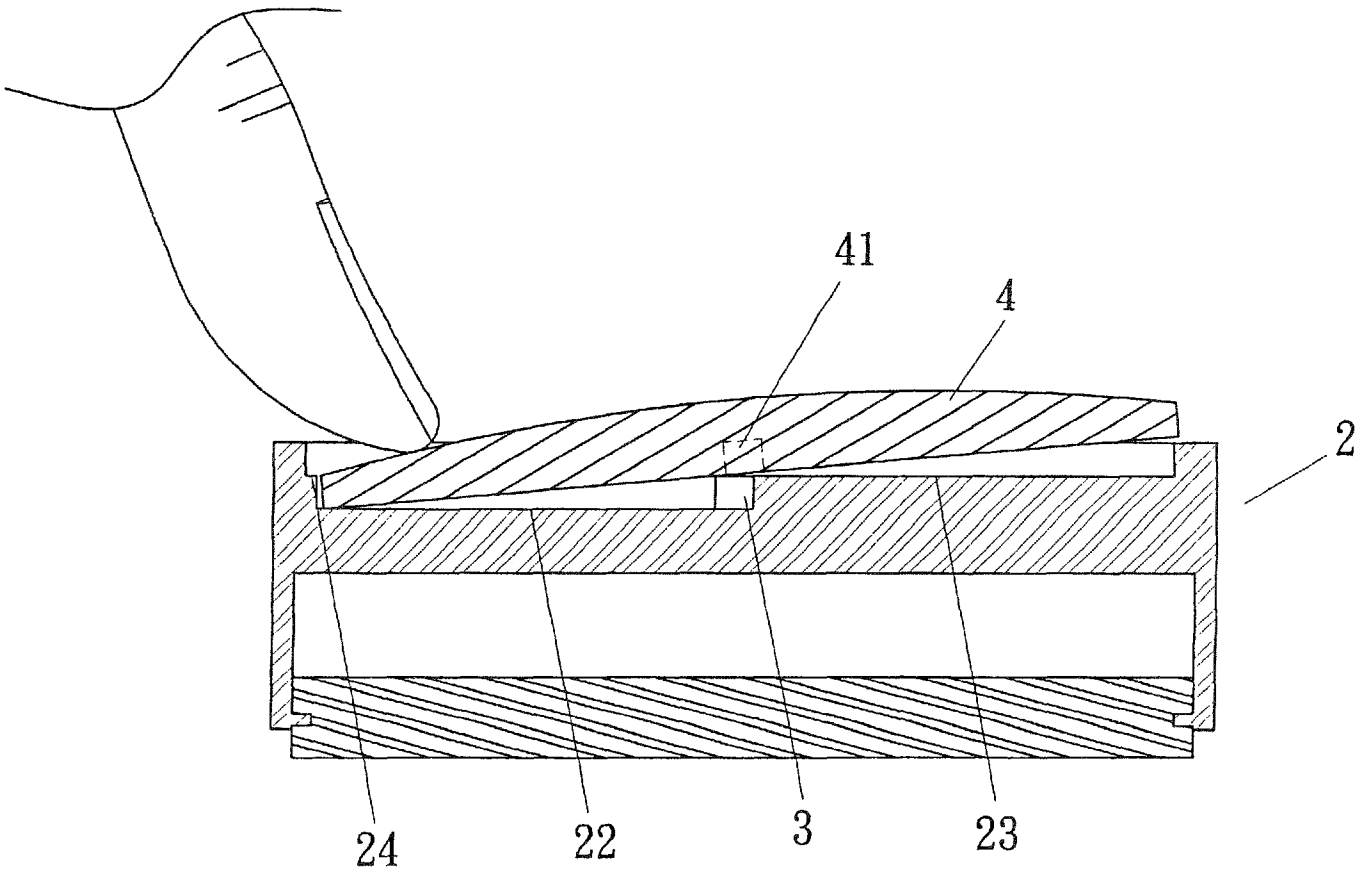
FIG. 8 is a sectional diagram showing how the cap element of the belt buckle of FIG. 6 is removed.

As shown in FIGS. 6, 6A and 7, in another embodiment of the present invention, the indentation 21 is formed of two intersecting circles and dimensioned to receive the cap element 4. The bottom surface of the indentation 21 again contains a deeper first bottom 22 and a shallower second bottom 23. In addition, the bottom surface of the indentation 21 further contains a narrow third bottom 24 between the first bottom 22 and the circumference of the indentation 21. The third bottom 24 is as high as the second bottom 23. The magnet 3 is configured slightly close to the third bottom 23, i.e. the magnet 3 is not mounted at the center of the indentation 21. As such, when the cap element 4 is placed inside the indentation 21, the magnetic attraction would automatically draw the cap element 4 to rest on the second and third bottoms 23 and 24. In this way, the cap element 4 will not be accidentally removed from the indentation 21 as its edge is supported by the third bottom 24. To remove the cap element 4 in the present embodiment, the user slides the cap element 4 away from the third bottom 24 so that a part of the cap element 4 is entirely above the first bottom 22. Then, by pressing the part of the cap element 4 above the first bottom 22, as shown in FIG. 8, the other part of the cap element 4 is raised out of the indentation 21 for easy removal of the cap element 4.

Figure 9:
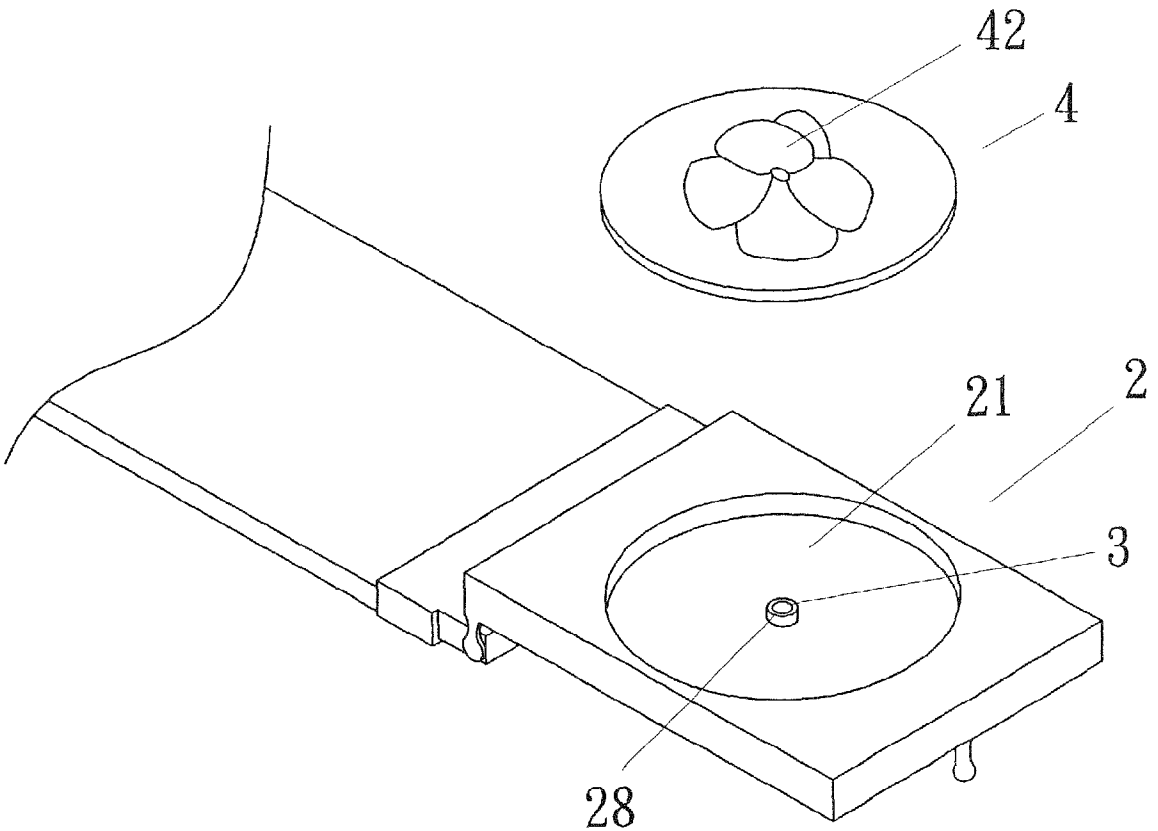
FIG. 9 is a perspective exploded diagram showing the various components of a belt buckle according to a third embodiment of the present invention.
Figure 10:
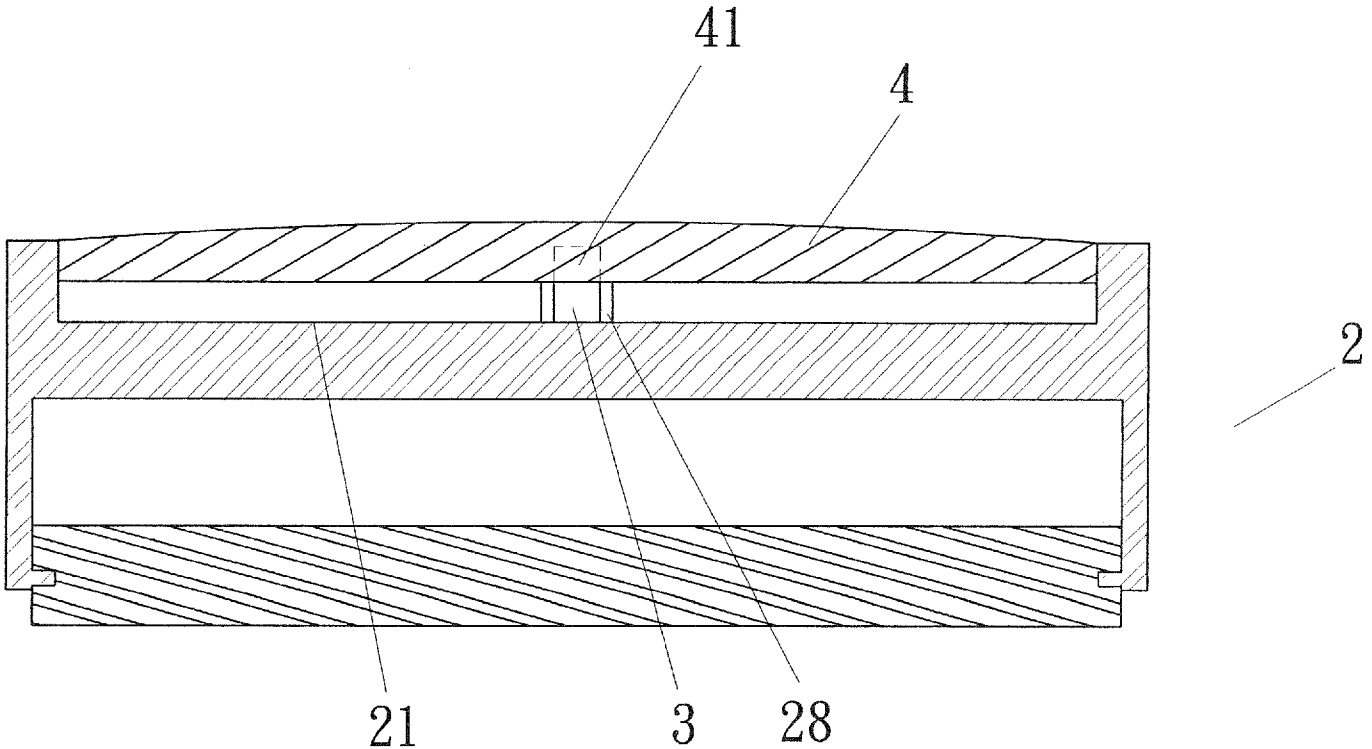
FIG. 10 is a sectional diagram showing the belt buckle of FIG. 9. fourth embodiment of the present invention.

In another embodiment of the present invention as shown in FIGS. 9 and 10, the indentation 21 has a flat bottom surface, instead of a stepwise bottom surface as in the previous embodiments. A rod 28 having an embedded magnet (not shown) is provided in the center of the indentation 21. As such, the cap element 4 can be held on top of the rod 28. A user can press any part of the cap element 4 other than the center to raise an opposite part of the cap element 4 for easy removal.

Figure 11:
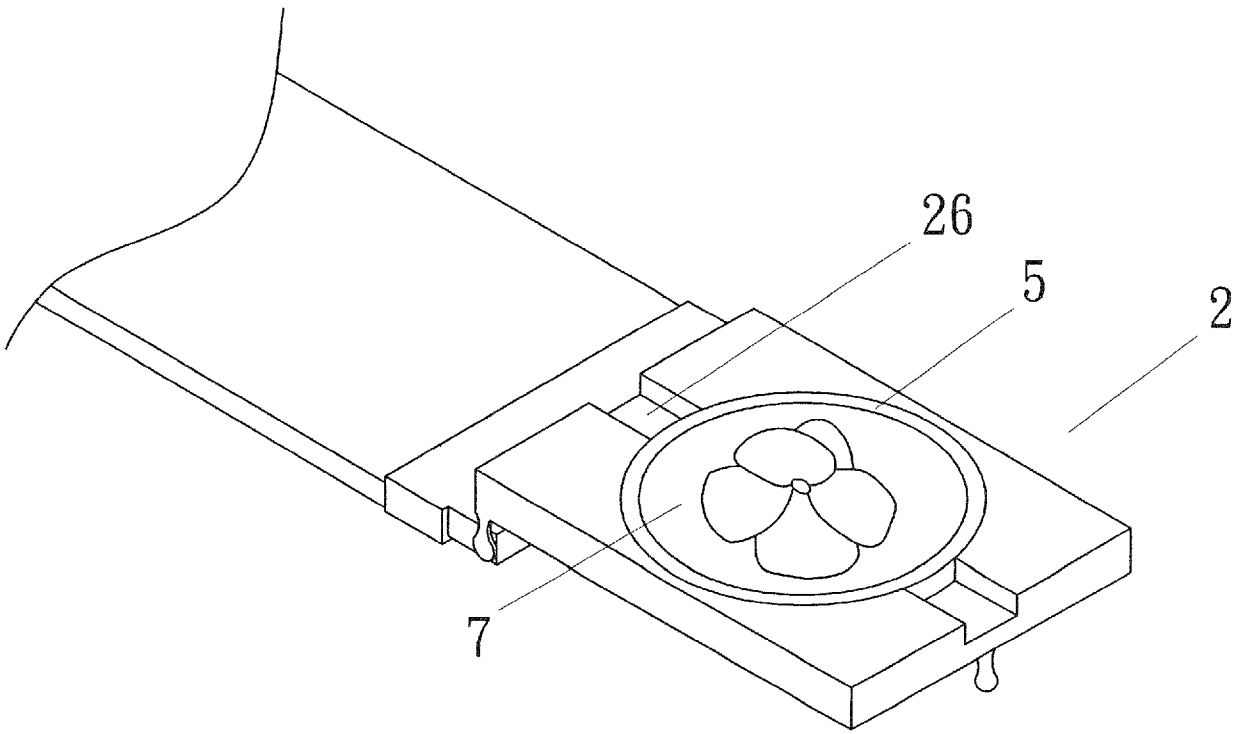
Figure 12:
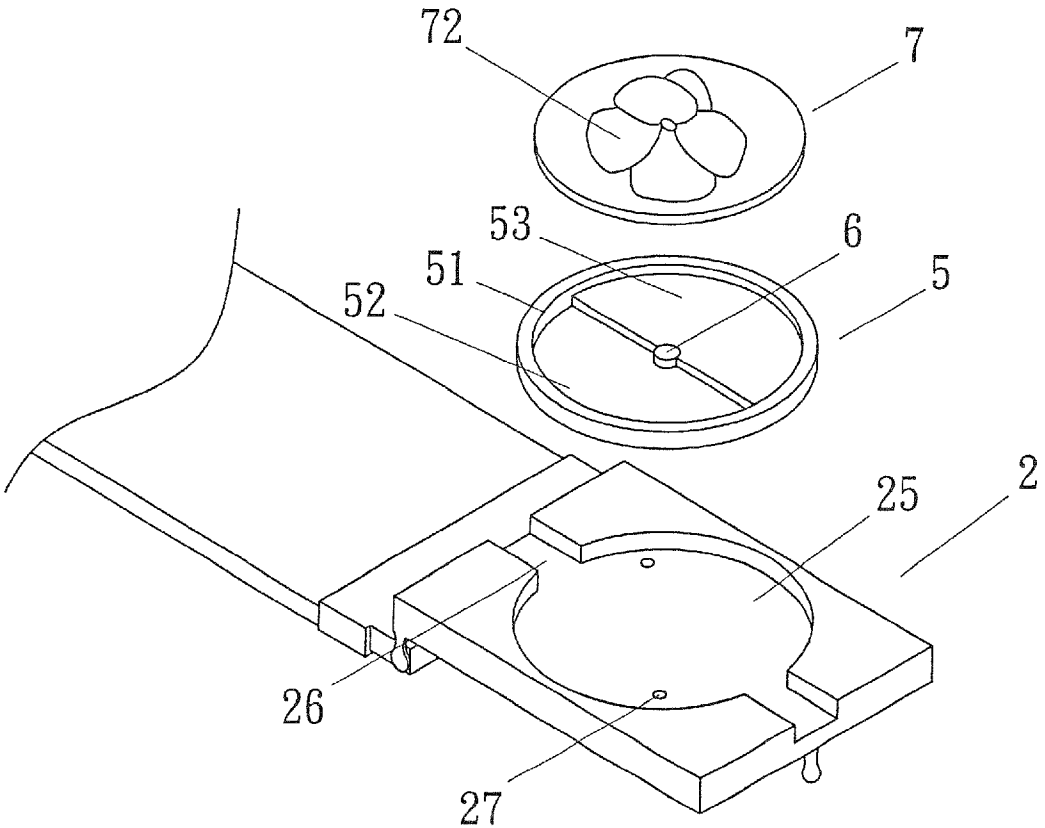
FIG. 12 is a perspective exploded diagram showing the various components of the belt buckle of FIG. 11.
Figure 13:
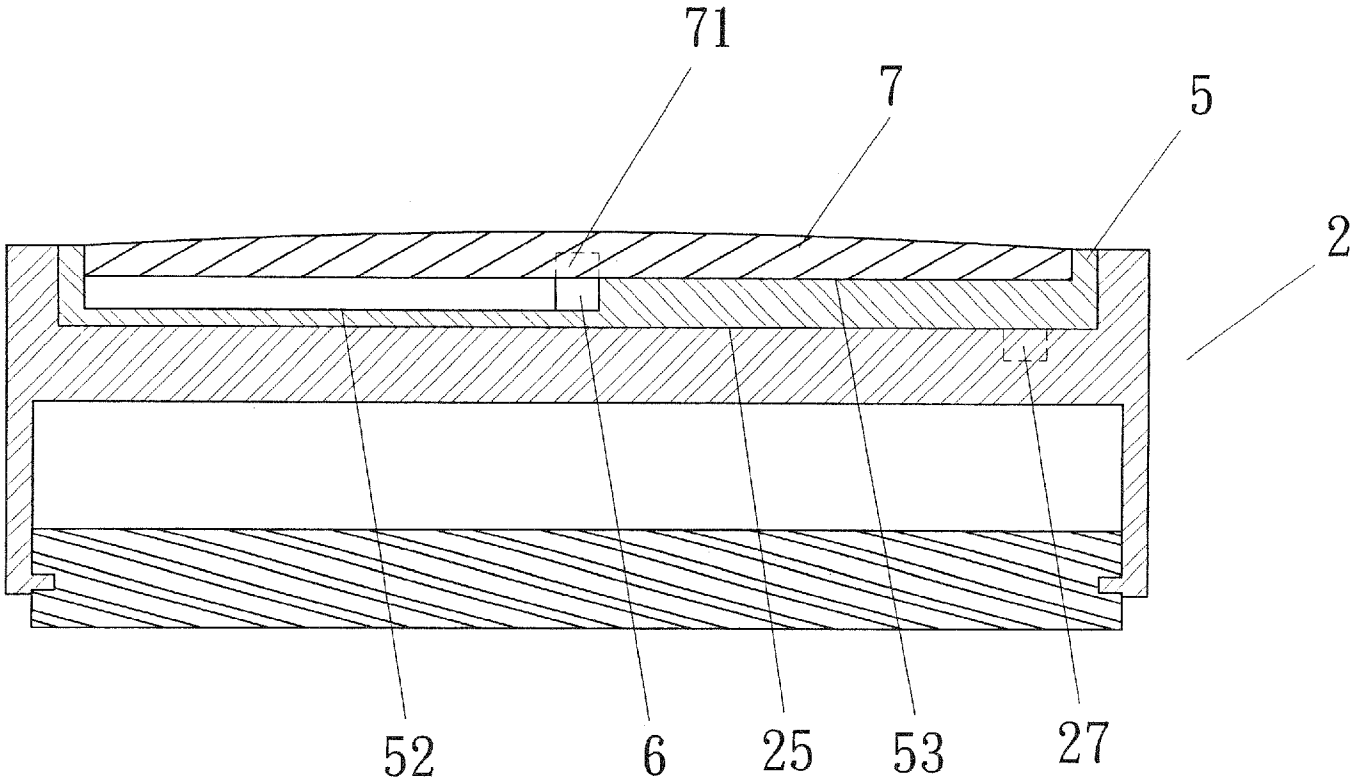
FIG. 13 is a sectional diagram showing the belt buckle of FIG. 11.

In yet another embodiment of the present invention as shown in FIGS. 11 and 12, the belt buckle 2 has an indentation 25 on the front surface of the body. The indentation 25 is extended to two opposing sides of the belt buckle 2 via two aligned troughs 26, respectively. On the flat bottom surface of the indentation 25, at least a magnet 27 is provided so as to attract and hold a carrier member 5 inside the indentation 25. The carrier member 5 can also be held inside the indentation 25 by other means such as clamping in alternative embodiments. The carrier member 5 has an indentation 51 on the front surface. The bottom surface of the indentation 51 is, like the previous embodiments, divided into two parts of substantially equal sizes, a first bottom 52 having a greater depth and a second bottom 53 having a smaller depth. A magnet 6 is fixedly positioned in the center of the indentation 51 at where the first and second bottoms 52 and 53 interface with each other. The indentation 51 allows the accommodation of a cap element 7. Another magnet 71 is fixedly embedded on the bottom surface of the cap element 7. The magnet 71 has a polarity opposite to that of the magnet 6 and is positioned such that, as shown in FIG. 13, when the cap element 7 is placed inside the indentation 51, the magnets 6 and 71 are next to each other. The magnetic attraction between the magnets 6 and 71 therefore removably holds the cap element 7 inside the indentation 51. The front surface of the cap element 7 can have an ornamental pattern 72.

The removal of the cap element 7 from the carrier member 5 can be conducted in the same way described earlier. To remove the carrier member 5 out of the indentation 25, a user could use the finger to reach the rim of the carrier member 5 through the trough 26 and lift the carrier member 5 out of the indentation 25.

Figure 14:
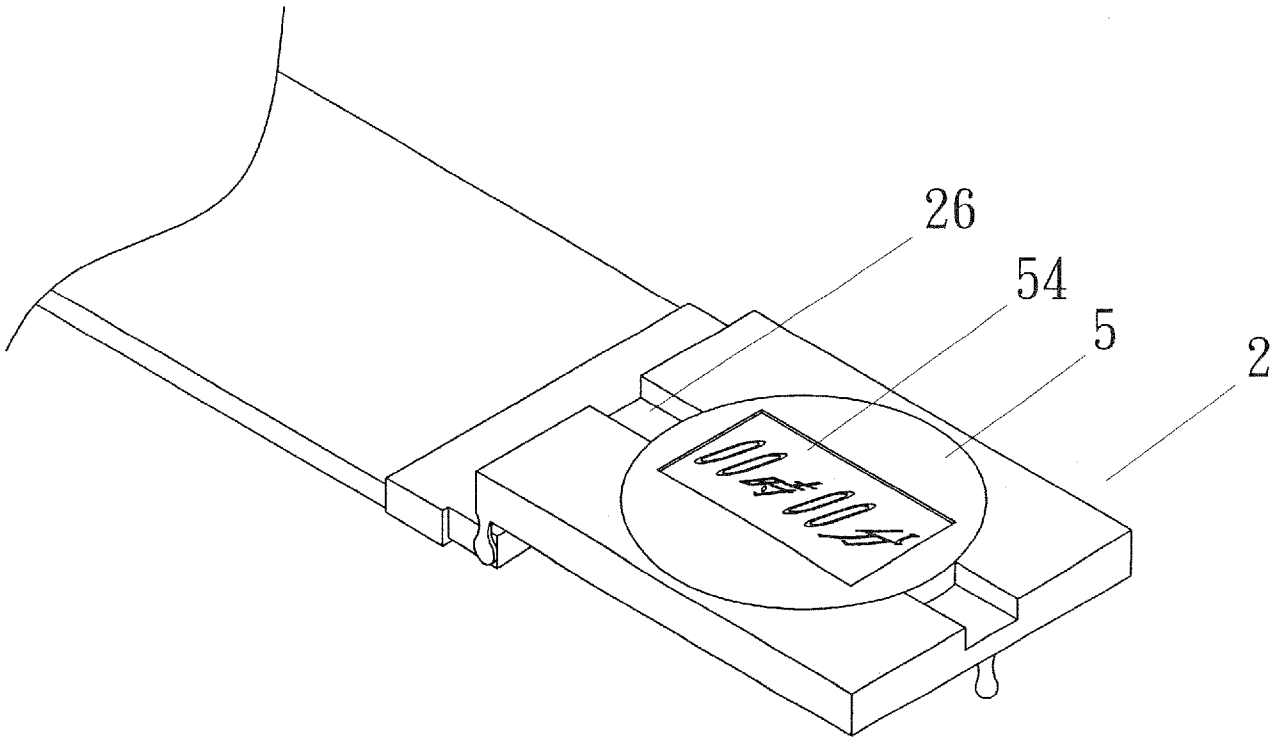
FIG. 14 is a perspective diagram showing an electronic clock is provided in the belt buckle of FIG. 11.
Figure 15:
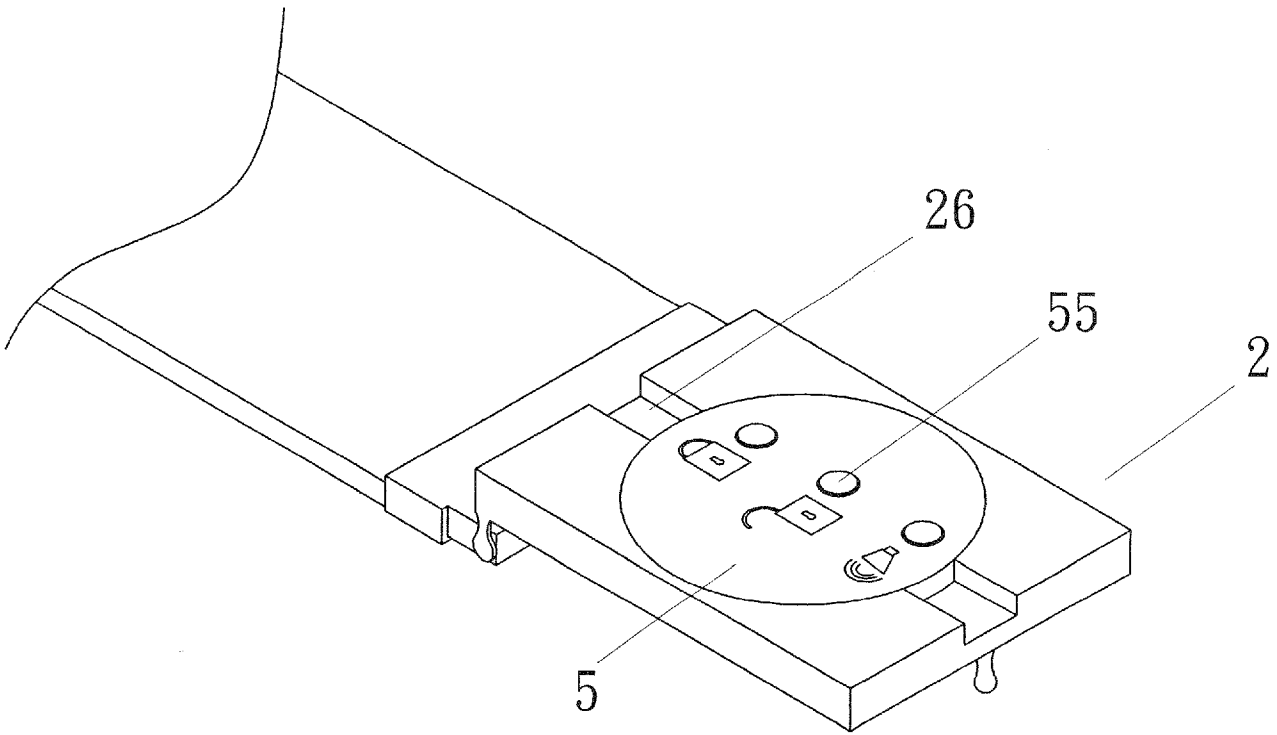
FIG. 15 is a perspective diagram showing a remote control is provided in the belt buckle of FIG. 11.

The carrier member 5 itself can have other integrated functions. For example, the carrier member 5 can contain an electronic clock 53 with the readings shown on the back surface. As shown in FIG. 14, when the cap element 7 is removed, the carrier member 5 can be flipped with its back surface facing outwards. A user therefore can enjoy the various timing functions of the electronic clock 54. For another example, as shown in FIG. 15, a remote control 55 (e.g., for the garage door) is integrated to the carrier member 5 with its control buttons on the back surface so that the user will never forget to bring remote control or where the remote control is placed. These are only two examples and various other utility functions can be integrated to the carrier member 5.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-functional belt buckle comprising:

a body having a circumference and a front surface formed with an indentation, said indentation having a first bottom surface, a second bottom surface adjacent to and higher than the first bottom surface to form a junction plane between them, and a third bottom surface extended from said circumference of said body into the first bottom surface and having same depth as said second bottom surface, the first bottom surface and the third bottom surface being on a same circumferential wall, opposite of the second bottom surface;

a cap element removably embedded in said indentation;

a first magnet fixedly positioned in a center of the junction plane of said first and second bottom surfaces, said first magnet being slightly close to said third bottom surface;

a second magnet fixedly embedded on a bottom surface of said cap element, said second magnet having a polarity opposite to that of said first magnet;

wherein when said cap element is put inside said indentation, magnetic attraction would automatically draw said cap element to rest on said second and third bottom surfaces thereby preventing said cap element from being accidentally removed from said indentation as an edge of said cap element is supported by said third bottom surface; when desired to remove said cap element from said indentation, it is necessary to horizontally slide said cap element along a planar surface away from said third bottom surface and then press a part of said cap element to raise other part of said cap element for easy removal of said cap element.

2. The multi-functional belt buckle as claimed in claim 1, wherein said cap element has an ornamental pattern.

* * * * *